United States Patent [19]

Ricciardi

[11] 4,241,658

[45] Dec. 30, 1980

[54] DUPLICATING MACHINE WITH DUPLEXING CAPABILITY

[75] Inventor: Mario J. Ricciardi, Glenview, Ill.

[73] Assignee: A. B. Dick Company, Chicago, Ill.

[21] Appl. No.: 910,640

[22] Filed: May 30, 1978

[51] Int. Cl.[3] ..... B41F 5/02; B41F 21/04; B41F 21/08; B41F 5/22

[52] U.S. Cl. ..... 101/217; 101/230; 101/231; 101/183; 101/410; 101/411; 101/246; 271/186; 271/DIG. 9; 355/24

[58] Field of Search ..... 101/230, 231, 232, 409, 101/410, 411, 183, 246; 271/184–186, 69, 277, 82, 225, DIG. 9; 355/23, 24

[56] References Cited

U.S. PATENT DOCUMENTS

| | | | |
|---|---|---|---|
| 252,153 | 1/1882 | Stonemetz | 101/230 X |
| 666,325 | 1/1901 | North | 101/230 |
| 1,465,386 | 8/1923 | White | 101/410 X |
| 3,865,362 | 2/1975 | Luffy et al. | 101/410 X |
| 3,899,970 | 8/1975 | Jurny et al. | 101/230 |
| 4,120,244 | 10/1978 | Wirz | 101/230 |

FOREIGN PATENT DOCUMENTS

| | | | |
|---|---|---|---|
| 2547251 | 10/1976 | Fed. Rep. of Germany | 101/230 |

*Primary Examiner*—J. Reed Fisher
*Attorney, Agent, or Firm*—McDougall, Hersh & Scott

[57] ABSTRACT

A system for duplicating images on copy sheets utilizing an impression cylinder. The system provides for transfer of an image to one side of each sheet, and the sheet may then be reversed to locate the sheet on the impression cylinder, trailing edge first. The reversing is in synchronism with a second image whereby this second image may be transferred to the opposite side of each sheet. The impression cylinder is provided with a first gripper for engaging the leading edge of each sheet when the sheet is first fed to the impression cylinder. A second gripper is provided on the impression cylinder for engaging the trailing edge of each sheet, and this second gripper turns around to achieve the reversing action after application of the first image. The first gripper is externally mounted and is movable relative to the impression cylinder whereby the relative positions of the grippers can be changed so that different size sheets can be duplexed. Furthermore, very long sheets can be imaged on one side with this arrangement by utilizing the second gripper to engage the leading edge of each sheet and by moving the externally mounted gripper to an out-of-the-way position.

27 Claims, 31 Drawing Figures

FIG. 3a
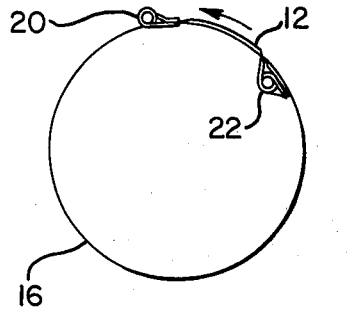
FIG. 3b
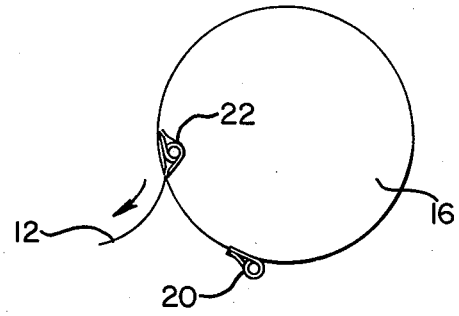
FIG. 3c
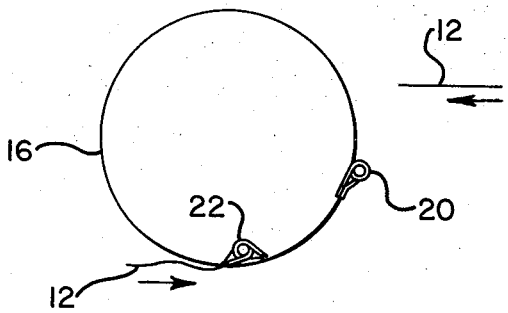
FIG. 3d
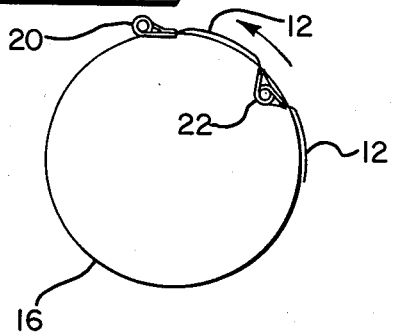
FIG. 4a
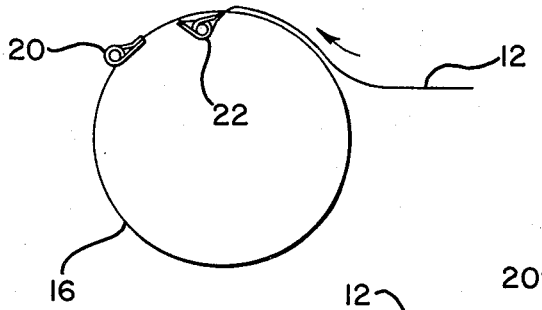
FIG. 4b
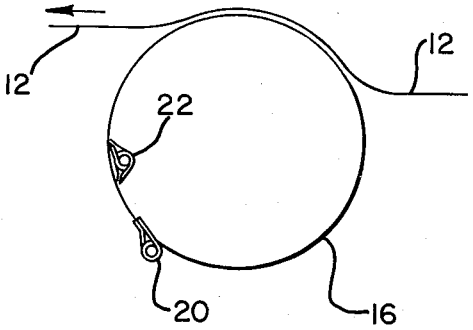
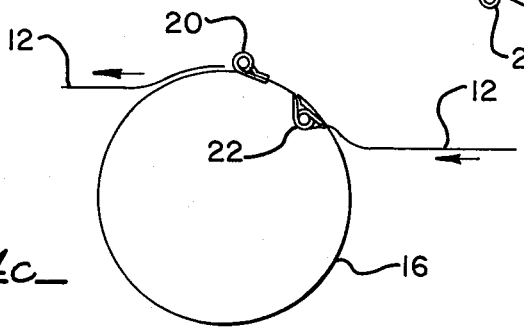
FIG. 4c

DUPLICATING MACHINE WITH DUPLEXING CAPABILITY

BACKGROUND OF THE INVENTION

1. Field of the Invention

This invention relates to a system for the production of duplicate copies of images. The invention is particularly concerned with duplicators of the type wherein copy sheets can be imaged on both sides while being supported by a single carrier, for example, an impression cyclinder.

Since copy sheet material of the type conventionally employed can readily accept images on both sides, it is highly desirable to provide equipment suitable for transferring images to both sides of a copy sheet. This provides clear savings in the amount of paper employed, additional savings in the amount of space occupied by the copies produced, savings in production time, and savings in cost of equipment.

2. Description of the Prior Art

Various systems have been developed to produce copy sheets imaged on both sides (hereinafter referred to as "duplexing"). Some systems, including Stonemetz U.S. Pat. No. 252,153, teach means for duplexing copies wherein a sheet is introduced between an impression cylinder and a type cylinder. In that system, the type cylinder carries two forms for transferring separate images, and a "blank" area is defined between the forms. The type cylinder makes one revolution while the smaller impression cylinder makes three revolutions. The copy sheet is printed on one side during a first revolution of the impression cylinder and discharged from the equipment. The impression cylinder makes an additional revolution while the "blank" area of the type cylinder passes, and the copy sheet is then re-fed, trailing edge first, for formation of the other image on the other side of the copy sheet during the third revolution of the impression cylinder.

Zahradnik application Ser. No. 858,606, filed on Dec. 7, 1977, entitled "Staging Mechanism For Duplexing Copy Machines" and Borneman applications Ser. No. 826,847, filed on Aug. 22, 1977, now U.S. Pat. No. 4,186,662, entitled "Duplexing Copying System", and Ser. No. 931,522, filed on Aug. 7, 1978, entitled "Duplexing Copying System" (The subject application and each of these applications being commonly assigned) disclose highly efficient means for achieving duplexing of copy sheets. These systems in particular provide means for delivering a copy sheet to an impression cylinder with the first image being transferred to one side of the sheet. Reversing means are associated with these constructions whereby the sheets are re-fed to the impression cylinder, trailing edge first. The impression cylinder then carries the sheets past image transfer means whereby an image is formed on the opposite side of each sheet.

First grippers employed with the respective impression cylinders engage the leading edge of each sheet fed to the impression cylinders. Each system also includes a second gripper which is involved in the reversing operation, the second gripper engaging the trailing edge of each sheet to achieve the second side image transfer.

In the case of the Zahradnik and first-filed Borneman applications, the systems include reversing stations which receive sheets after they are released by a first gripper. These reversing stations include mechanisms for re-feeding the sheets toward the second grippers whereby the formerly trailing edge of these sheets is engaged by the second grippers.

In the case of the latter-filed Borneman application, a continuation-in-part of the first-filed Borneman application, the second gripper incorporates separate gripper means with one gripper means engaging the trailing edge of each sheet as this trailing edge is first brought onto the impression cylinder. After release of the sheet by the first gripper, the second gripper is adapted to turn through 180° whereby the second gripper achieves re-feeding of the sheet to the impression cylinder without releasing the trailing edge.

Prior art statements submitted with the above entitled applications are hereby incorporated by reference.

SUMMARY OF THE INVENTION

For purposes of illustrating the present invention, the following description will specifically refer to systems wherein ink images are repeatedly formed on a blanket cylinder or the like. Copy sheets are introduced between the blanket cylinder and an adjacent impression cylinder for transfer of the ink images to the copy sheets. Applications beyond such offset duplicators are contemplated, however, and such applications will be apparent after consideration of the description of the invention.

The invention is particularly adaptable to either the formation of images on one side of copy sheets ("simplexing"), or to the duplexing of copy sheets. Offset equipment wherein the master cylinders, blanket cylinders and impression cylinders of the equipment are of conventional size can be readily utilized. The copy sheets are also adapted to be fed to the equipment at high rates of speed so that simplex or duplex copies can be obtained at rates comparable to customary rates of production with high quality offset duplicating equipment.

Where duplexing is contemplated, the system involves the provision of separate ink images on a blanket cylinder. In accordance with this practice, a master cylinder having inking means associated therewith is employed. The blanket cylinder then picks up the ink images from the master cylinder. Drive means rotate these cylinders and an associated impression cylinder in unison while copy sheets are fed between the blanket cylinder and impression cylinder.

Feed means for the copy sheets introduce one sheet for each revolution of the impression cylinder, and first gripper means associated with the impression cylinder are adapted to successively engage the leading edge of each sheet. The feeding of each sheet is synchronized with the first image on the blanket cylinder so that one side of each sheet receives the first image.

A second rotatably mounted gripper includes separate gripping jaws whereby the trailing edge of each sheet fed to the impression cylinder can be engaged by one set of gripping jaws. The first gripper releases each sheet, and the second gripper then rotates through 180° whereby the second gripper operates to pull the sheet back onto the impression cylinder. The formerly trailing edge of the sheet now becomes the leading edge, and the unimaged side of the sheet is exposed on the impression cylinder whereby the sheet can be moved into position for application of an image on this side of the sheet. The other gripping jaws of the second gripper engage the trailing edge of the next sheet fed to the apparatus, and the cycle is then continuously repeated with one sheet being fed to the apparatus during each revolution of the impression cylinder, and with one duplexed sheet being discharged for each revolution.

In accordance with this invention, at least one of the grippers is associated with mounting means which are movable relative to the impression cylinder. The mounting preferably takes the form of an external mounting whereby the grippers associated with the mounting can be moved relative to the impression cylinder and, more significantly, relative to the other gripper.

The arrangement of this invention generally provides a system which is highly versatile in terms of the sizes of copy sheets that can be produced. The particular means for mounting the movable gripper permits, in the case of a standard size impression cylinder, the duplexing of sheets of various widths while prior embodiments were limited to duplexing of sheets of a single width, for example, 8½ inch size.

The provision of the movable gripper achieves the significant additional advantage of permitting the imaging on impression cylinders of standard size long sheets including sheets 17 inches in length which is a size particularly employed in certain areas. Reference is made in particular to equipment previously developed for duplexing purposes wherein first and second grippers are located in spaced relationship on an impression cylinder. The presence of these grippers severely limits the length of copy sheets usable on impression cylinders of standard size so that such prior equipment was not practical for applications where formation of images on long sheets was desired in addition to the availability of the duplexing function.

Figure 6:
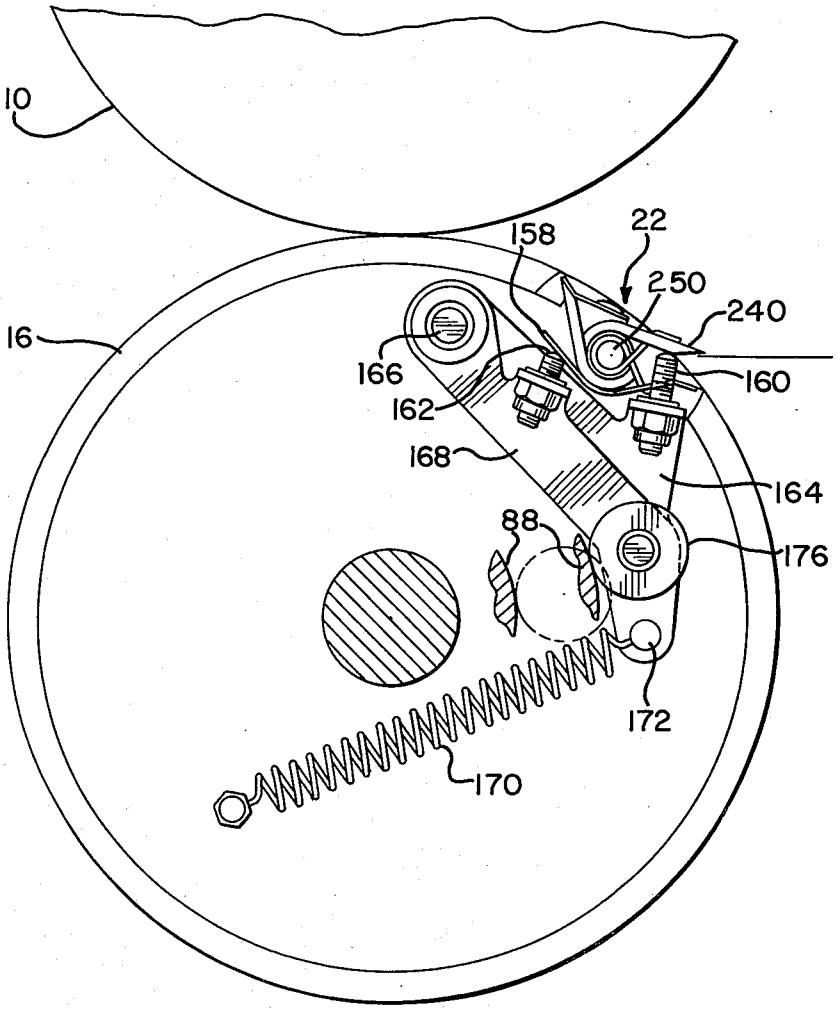
Figure 5:
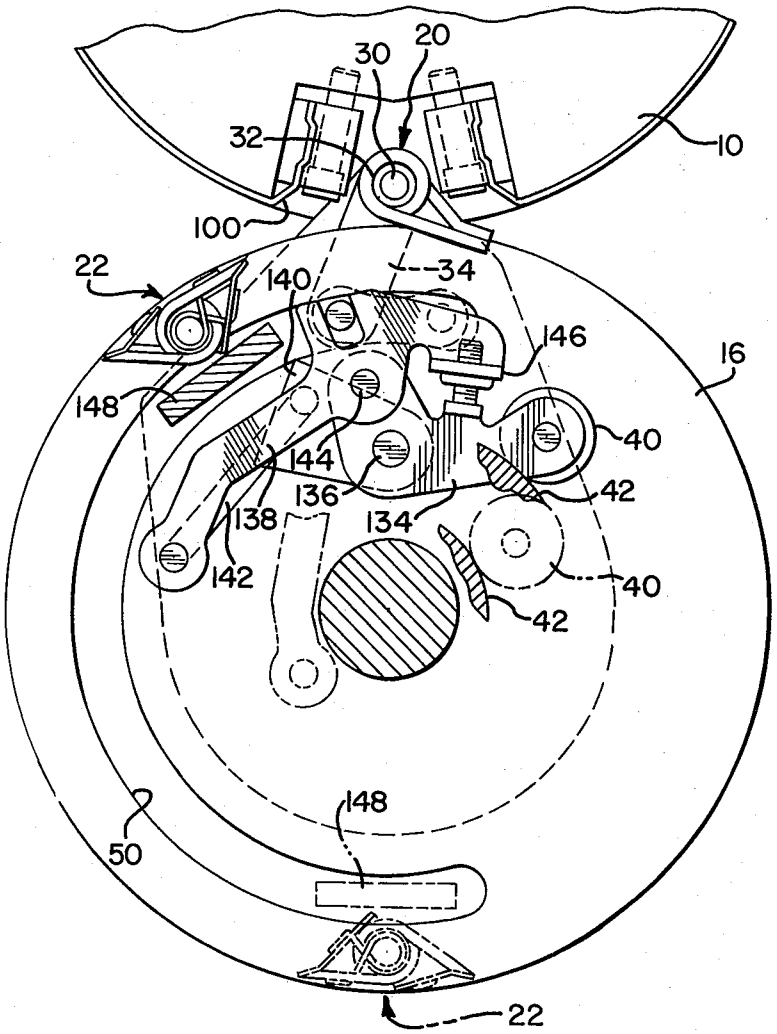
Figure 7:
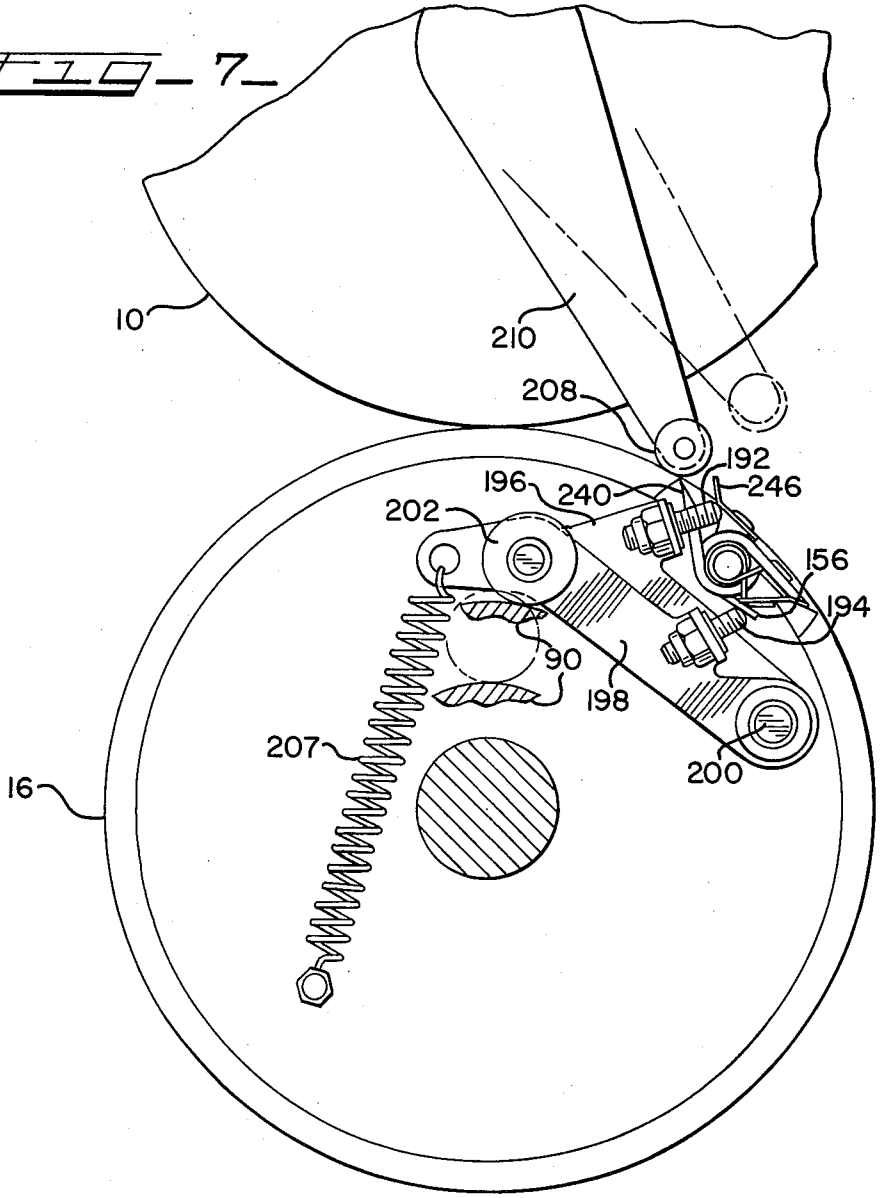
Figure 8:
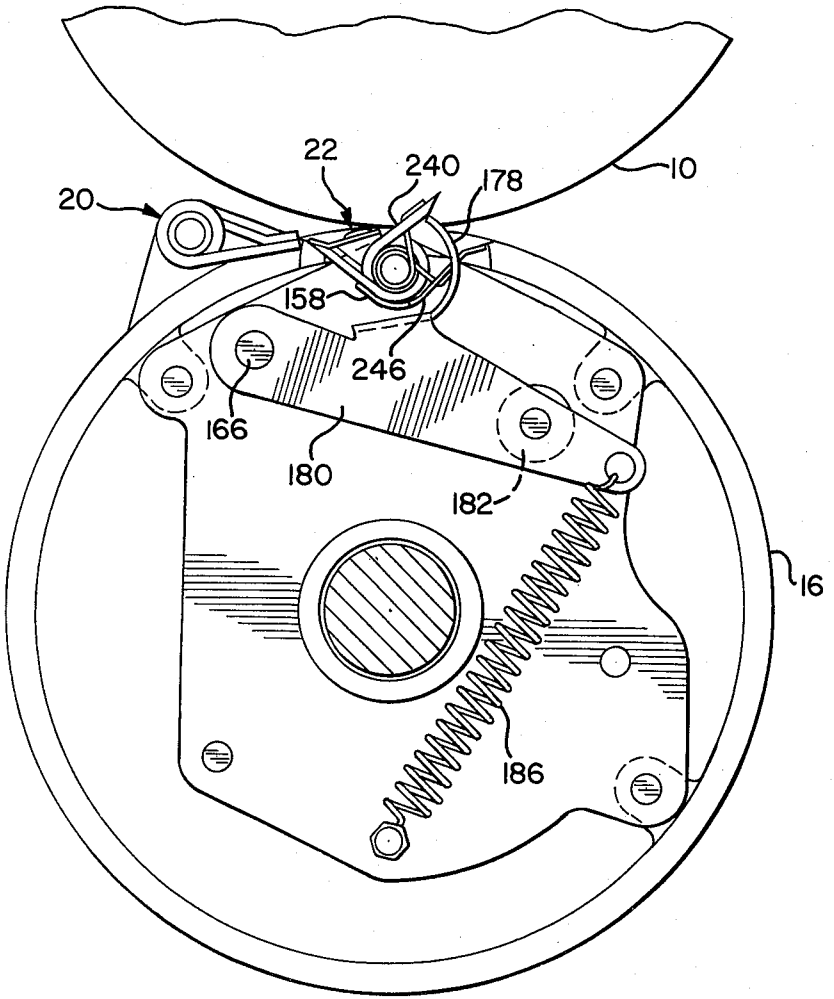
Figure 10:
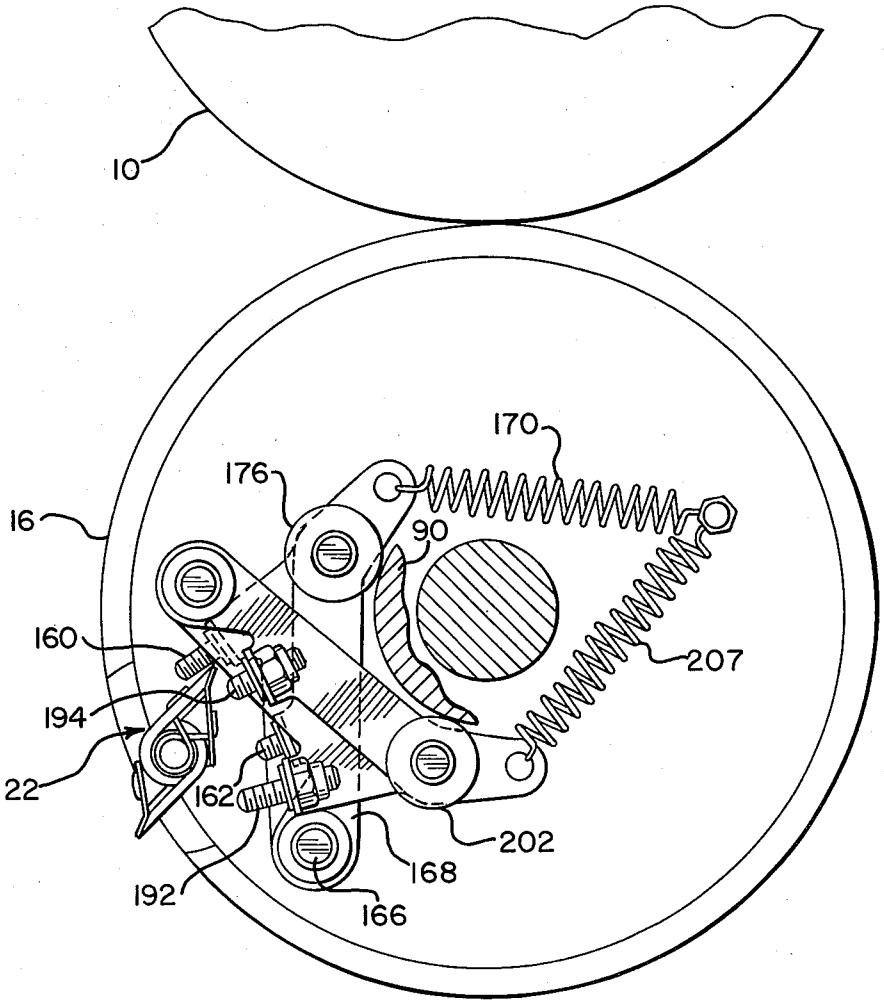
Figure 9:
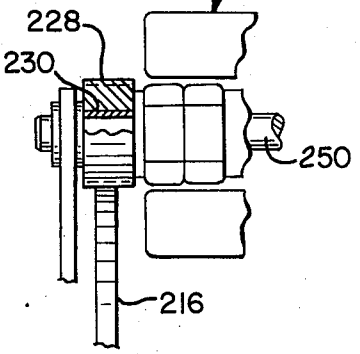
Figure 12:
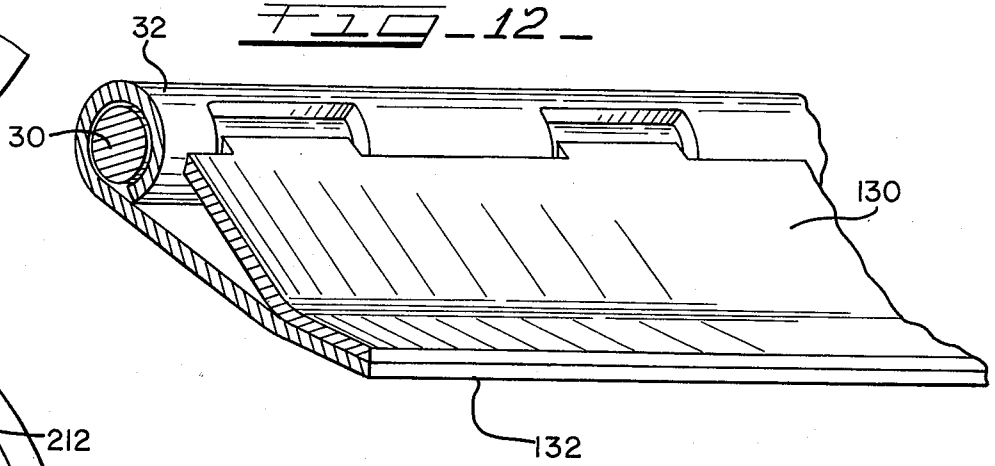
Figure 11:
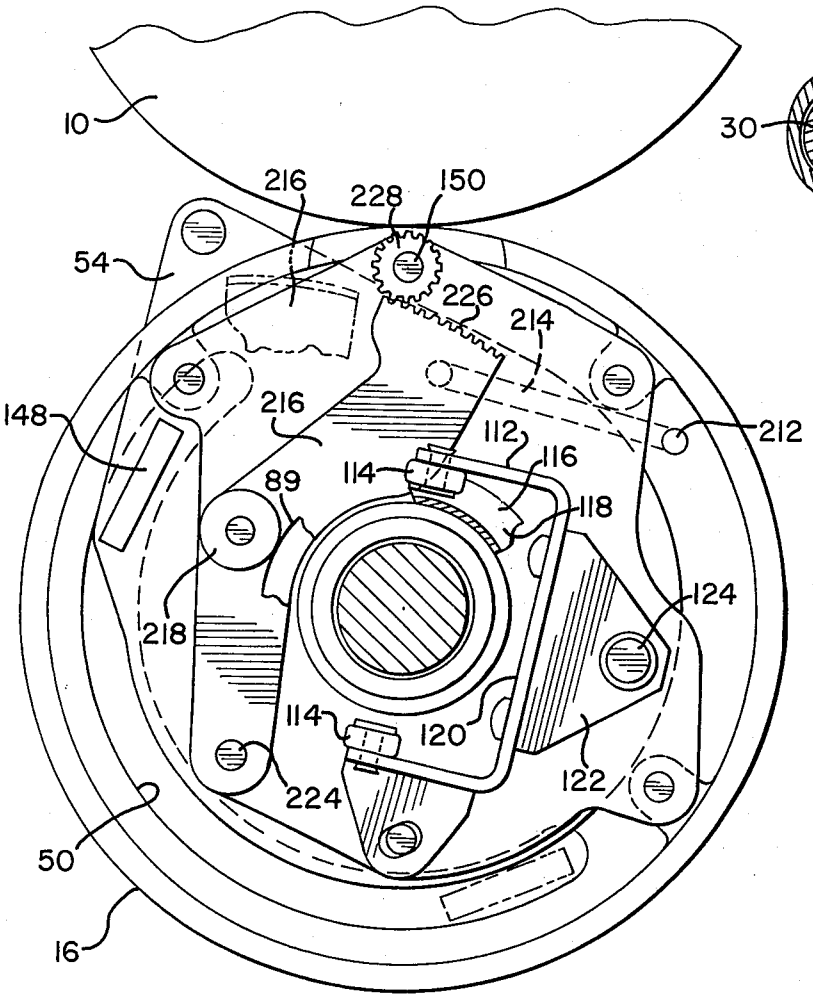
Figure 13:
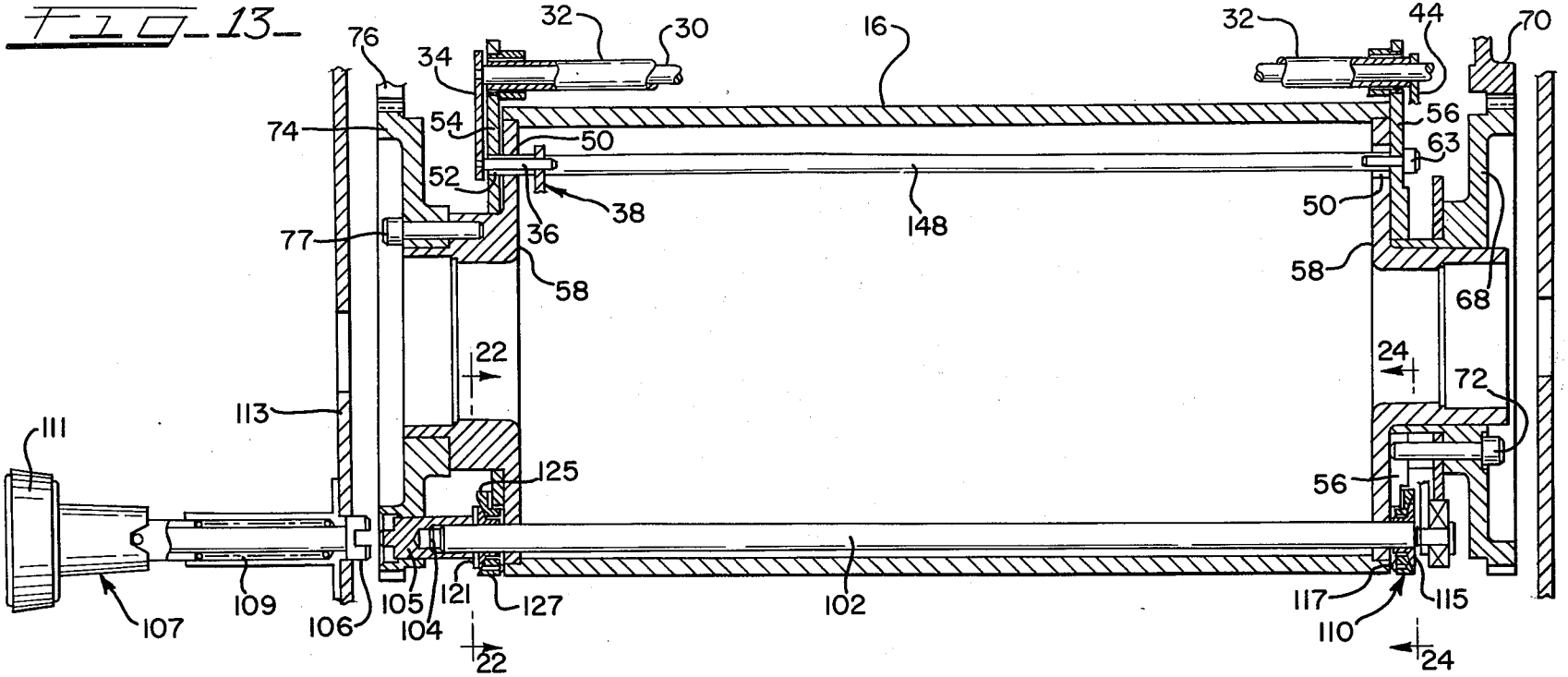
Figure 14:
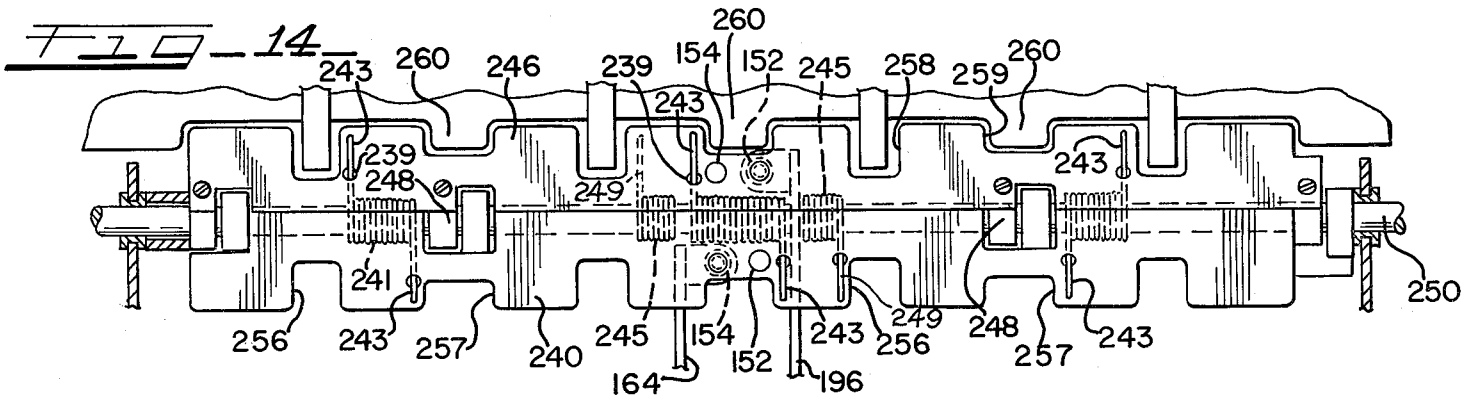
Figure 15:
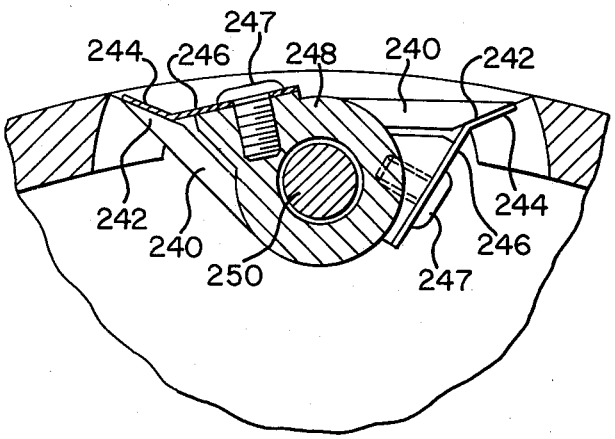
Figure 16:
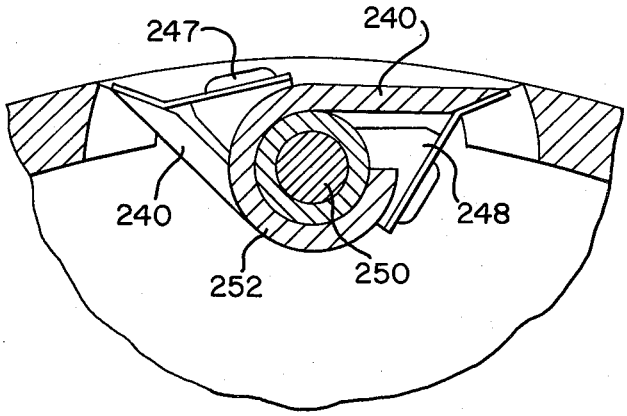
Figure 17:
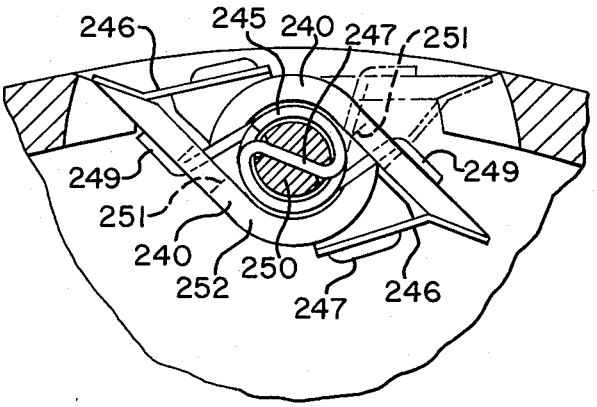
Figure 18:
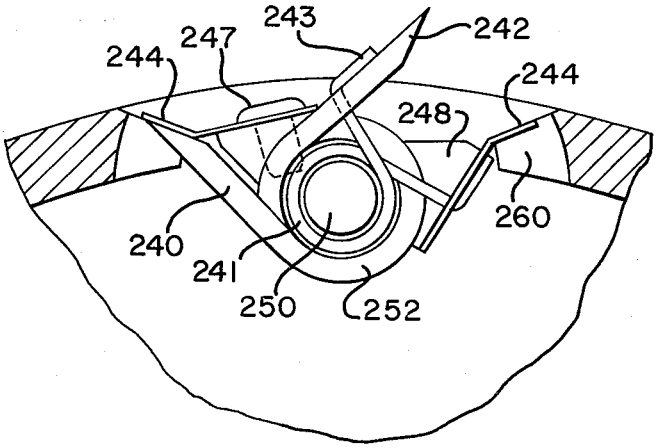
Figure 19:
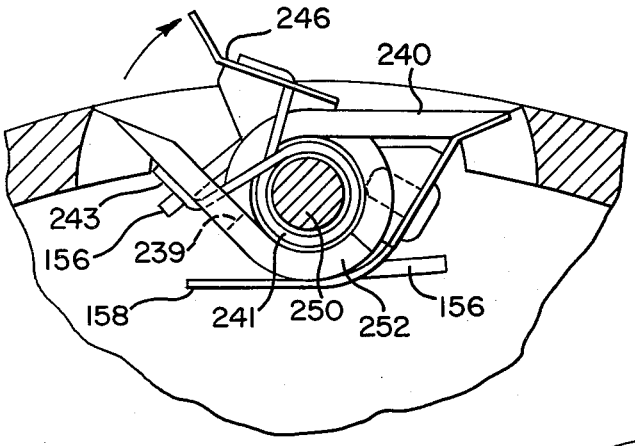
Figure 21:
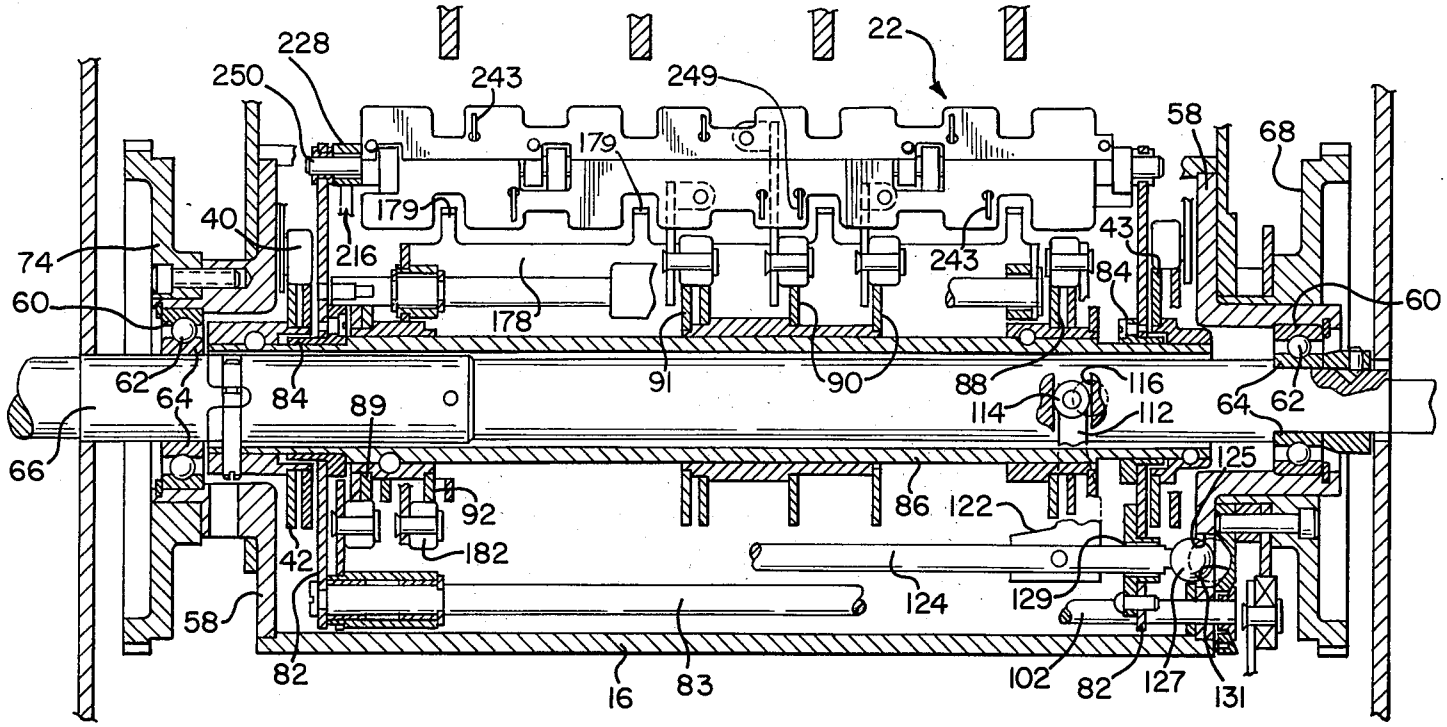
Figure 21A:
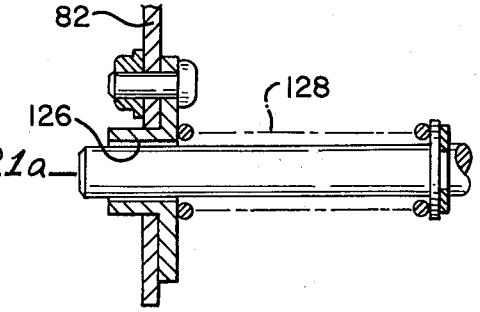

FIGS. *3a–3d* comprise schematic views illustrating stages of operation during duplexing of copy sheets;

FIGS. *4a–4c* comprise schematic illustrations of stages of operation during simplexing of long copy sheets;

FIG. 5 is a side elevational view, partly in section, illustrating mechanisms utilized for operating first gripper means employed in the system and for achieving relative movement of respective gripper means;

FIG. 6 is a side elevational view, partly in section, illustrating jaw operating means for the second gripper;

FIG. 7 is a side elevational view, partly in section, illustrating edge control means utilized in association with the second gripper;

FIG. 8 is a side elevational view, partly in section, illustrating additional jaw control means and edge holding means utilized in the construction;

FIG. 9 is a fragmentary view illustrating the drive means for rotating the second gripper utilized in the construction;

FIG. 10 is a side elevational view, partly in section, further illustrating the second gripper control means;

FIG. 11 is a side elevational view, partly in section, illustrating the first gripper drive mechanisms for changing the relative position of the first gripper;

FIG. 12 is a fragmentry perspective view illustrating the first gripper structure;

FIG. 13 is a vertical, sectional view of the impression cylinder particularly illustrating the means locking the cylinder and associated external gripper in place relative to the cylinder drive gear;

FIG. 14 is a plan view of the second gripper construction;

FIGS. 15 through 20 comprise fragmentary, cross-sectional views of the second gripper construction illustrating various operating stages thereof;

FIG. 21 is a vertical, sectional view of the impression cylinder illustrating the second gripper construction as well as associated operating cams and cam shafts;

FIG. 21*a* is a detailed view illustrating details of a shifting mechanism utilized in the construction.

Figure 22:
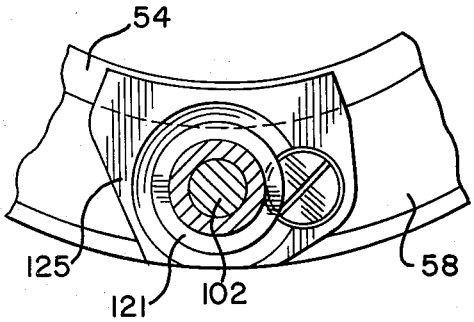
Figure 24:
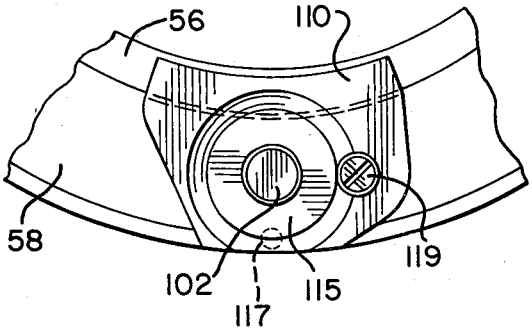
Figure 23:
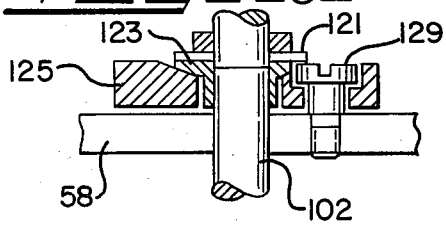
Figure 25:
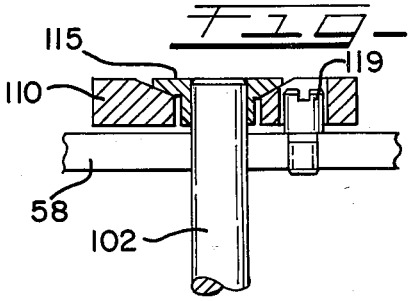

FIG. 22 is an enlarged fragmentary cross-sectional view taken about the line 22—22 of FIG. 13;

FIG. 23 is a cross-sectional view of the structure shown in FIG. 22;

FIG. 24 is an enlarged, fragmentary, cross-sectional view taken about the line 24—24 of FIG. 13; and, FIG. 25 is a cross-sectional view of the structure shown in FIG. 24.

DESCRIPTION OF THE PREFERRED EMBODIMENTS

Figure 1:
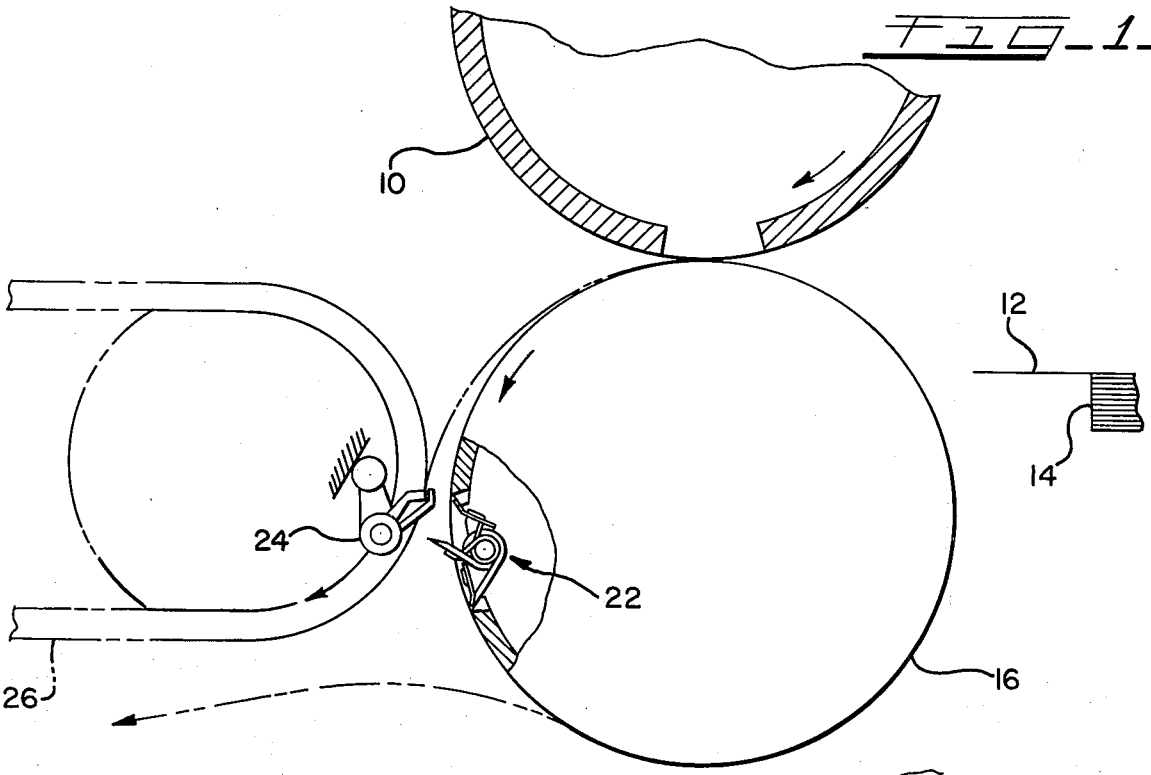
FIG. 1 is a schematic illustration of duplicating equipment including a blanket cylinder, impression cylinder and copy sheet pick-up means.

FIG. 1 of the drawings illustrates an offset duplicating arrangement wherein a master cylinder (not shown) is employed in association with a blanket cylinder 10. For a duplexing operation in accordance with this invention, the master cylinder is provided with first and second image plates or sheets or with a single plate or sheet defining first and second image areas. The masters are attached to the master cylinder in conventional fashion, and any suitable ink supply will be utilized in association therewith. In the case of a simplexing operation, a single image area would be involved.

The blanket cylinder 10 is also of conventional design so that ink images will be transferred to the blanket cylinder. It will be apparent that these ink images will be in separate locations on the blanket cylinder in the case of duplexing.

The features of this invention are adaptable to cylinder of various sizes, depending upon the size of the copies desired. It is to be noted, however, that the invention is adapted for the use of standard cylinder sizes in order to produce copies of a variety of conventional sizes. For example, standard size master cylinders will hold separate masters for producing images on 8½×11 inch paper with the long axes of the masters being positioned parallel with the cylinder axis. The images on the blanket cylinders can be similarly oriented without difficulty, and 8½×11 inch copy sheets are readily fed by conventional means with the side or long edges of the copy sheets comprising the leading and trailing edges during movement through the equipment.

Furthermore, the adjusting capability of the invention permits setting up for duplexing of sheets of different width, for example, sheets of 8 inch width or less. Finally, in the case of simplexing operations, particularly long sheets, for example 17 inches in length, are easily handled.

The copy sheets 12 are conventionally located in stack 14 and are fed one at a time toward impression cylinder 16 by any suitable feeding means 18. In accordance with conventional practice, the impression cylinder grips the leading edge of the copy sheet, and thereby carries the copy sheet between the impression cylinder and blanket cylinder for transfer of ink images to the copy sheet.

Figure 2:
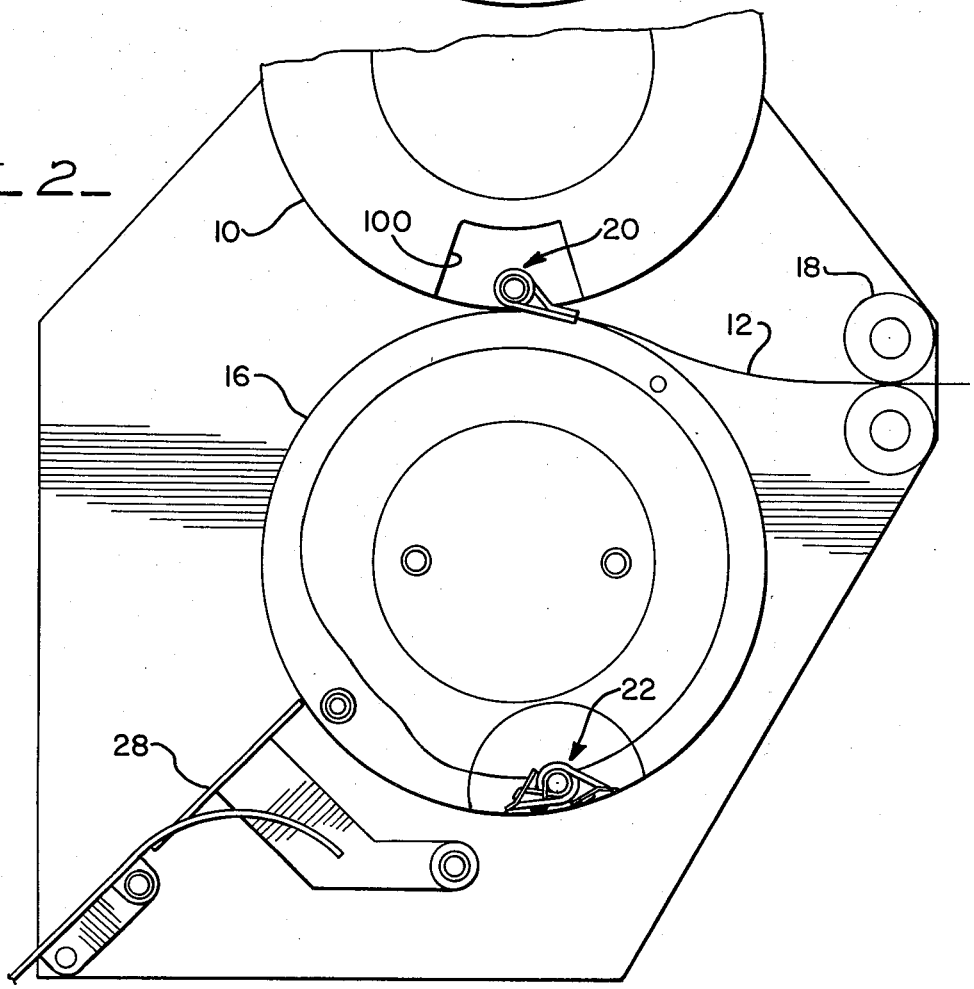
FIG. 2 is a side elevational view of the duplicating equipment illustrating grippers of the type employed in the equipment.

As shown in FIG. 2, a first gripper 20 is in engagement with the leading edge of the copy sheet. In order to accomplish duplexing of a sheet 12, a second gripper 22 is employed. In addition, means are provided for directing the sheet imaged on one side to a reversing station which may be designed in accordance with the aforementioned applications.

The gripper 22 is of the type including separate gripping jaws whereby the trailing edge of each sheet to be duplexed will be engaged by this gripper. This engagement of the trailing edge preferably occurs prior to completion of the formation of the first imaged, that is, just after the trailing edge is fed onto the impression cylinder. When the gripper 22 rotates through 180° while the sheet 12 is in the reversing station, the gripper 22 will then serve to draw this sheet out of the reversing station back onto the impression cylinder so that the opposite side of the sheet will be exposed to the blanket cylinder 10 for application of the second image. The reversing station may simply include means for maintaining each sheet in a desired position, for example, the plate 28 shown in FIG. 2. Thus, each sheet will be directed onto this plate and then withdrawn without any independent gripping of the sheet.

As indicated, this invention contemplates first and second grippers of a type permitting great versatility in terms of the sizes of copy sheets which can be employed. FIGS. *3a–3d* illustrate the operation of the apparatus in one mode wherein sheets 12 are to be imaged on two sides. A first sheet is shown in FIG. *3a* after engagement of its leading end by gripper 20 and after engagement of its trailing end by one set of grippers associated with gripper 22. FIG. *3b* illustrates this sheet after release by the gripper 20.

In FIG. *3b*, the sheet is entering the reversing station, and in FIG. *3c*, the gripper 22 has been inverted so that the formerly trailing edge of the sheet now becomes the leading end. It will also be noted that a second sheet 12 is being directed toward the impression cylinder with the gripper 20 being in position to engage the second sheet. This arrangement is shown in FIG. *3d* wherein gripper 20 holds the leading end of the second sheet with one side of gripper 22 engaging the trailing end of that sheet. The other side of gripper 22 still holds the first sheet, and the two sheets are then successively provided with images, the second sheet with a first side image and the first sheet with a second side image. The gripper 20 releases the first sheet for discharge in the conventional fashion while the second sheet is moved to the reversing station in the manner described.

It will be appreciated that the size of this sheet 12 shown in these figures controls the relative positions of the grippers 20 and 22. The structure of this invention thus accommodates sheets of different sizes since the relative positions of the grippers 20 and 22 can be changed.

FIGS. *4a–c* illustrate the manner in which this same structure permits the handling of particularly long sheets 12. In this illustration, the leading edge of the sheet is fed to the gripper 22 with one side of the gripper engaging the sheet. This leading edge is then released by the gripper as shown in FIG. *4b* whereby an image is formed on one side of the sheet, and the sheet is then moved to a collecting tray or the like.

The gripper 20 does not interfere with the imaging of the first sheet 12 since the tail end of this sheet engages the impression cylinder forwardly of the gripper 20. Accordingly, with the mechanisms of this invention to be described in greater detail hereinafter, an uninterrupted impression cylinder surface is available for imaging long sheets even though separate grippers are associated with the impression cylinder.

Sheets imaged on one or both sides may be collected by means of grippers 24 mounted on conveyor 26, this arrangement being of conventional design. The gripper 22 is adapted to open in timed sequence with the arrival of a gripper 24 at a collecting position, and the gripper 22 is adapted to push the sheets away from the cylinder surface to facilitate the collecting operation.

In accordance with this invention, the first gripper 20 is mounted on co-axial shafts including an inner shaft 30 and an outer shaft 32. As illustrated in FIGS. 5 and 13, these shafts are mounted outwardly of the periphery of impression cylinder 16. The inner shaft is tied to link 34, and a pin 36 connects this link to assembly 38, one lever 134 of this assembly supporting cam follower 40. This cam follower engages cam 42 (FIG. 21) whereby the inner shaft 30 can be driven independently of the outer shaft 32. A separate link 44 at the other end of the gripper 20 is also connected to outer shaft 32, and a corresponding pin and cam assembly is connected to this link whereby the outer shaft movement is controlled by engagement with cam 43 (FIG. 21). Both the pins are received in slots 52 to permit swinging movement of the levers 34 and 44. The slots 52 are defined by the respective external gripper support plates 54 and 56.

Slots 50 are defined by supports 58, these supports each carrying races 60 for bearings 62 (FIG. 21). Internal races 64 are secured to frame supported shaft 66 whereby the supports 58 are rotatable relative to this shaft. A tie bar 148 is attached by means of fasteners 63 to plates 54 and 56, and this bar extends through slots 50 whereby the assembly of the plates is movable relative to supports 58.

The drive gear 68 for the impression cylinder meshes with gear 70 attached to the blanket cylinder whereby the respective cylinders are adapted to rotate in unison. The gear 68 is secured to support plate 56 by means of screw 72. A second gear 74 positioned at the other end in FIG. 13 meshes with gear 76 which may be employed for driving the conveyor chain 26 supporting jaws 24. The gear 74 is tied to bearing support 58 by means of screw 77.

The respective ends of the impression cylinder 16 are attached by means of any suitable fasteners to supports 58. As shown in FIG. 21, the impression cylinder includes internally secured opposed end plates 82, and these end plates are connected by means of tie rods 83. The end plates are received around bearing sleeves 84 which loosely fit around tubular shaft 86.

A plurality of cam assemblies 88, 89, 90, 91, 92 and 93 are supported on shaft 86 in addition to cams 42 and 43. Shaft 86 is shiftable relative to shaft 66 whereby the cam positions can be shifted. This mechanism will be described in greater detail.

The assembly comprising support plates 54 and 56, external gripper coaxial shaft (30, 32), and gear 68 is maintained in a constant relative position with respect to blanket cylinder 10. This blanket cylinder defines a recessed area 100 which receives the external grippers and supporting coaxial shafts, and it is necessary that the recess and external grippers have a constant relationship to permit rotation of the cylinders.

The assembly comprising impression cylinder 16, opposed supports 58, and gear 74 is mounted for rotation relative to the assembly including plates 54 and 56. To permit this, the slots 50 which receive tie bar 148 extend for a substantial distance around supports 58 as shown in FIG. 11. The extent of these slots is preferably such that the assembly including the impression cylinder can be rotated approximately 180°. This permits positioning of the dual grippers 22 associated with the impression cylinder substantially adjacent the external gripper 20 while also permitting location of these grippers 180° apart for maximum size duplexing.

As best illustrated in FIGS. 13 and 22–25, a locking shaft 102 is employed for maintaining the respective assemblies in position after relative rotation. This shaft includes threaded end 104 carrying nut 105 for engagement by tool end 106. The tool 107 is normally held out of operating position by spring 109. When the knob 111 is pushed inwardly, the tool is engaged and rotation of the nut moves shaft 102 inwardly. The tool is mounted on the machine frame wall 113 in conventional fashion.

Clamp 115 is integral with shaft 102 and bears against brake shoe assembly 110 forcing plate 56 against the assembly including support 58 thereby locking the plate and assembly together. The spherical interface of the clamp and brake shoe as well as the fact that the brake shoe assembly is pivotable about the spherical head of pin 117 producing a gimbal effect, ensures uniform intimate contact between the assembly and plate. Shoulder screw 119 captures the brake shoe assembly preventing the same from rotating.

Turning nut 105 on the threads of shaft 102 advances a wear plate 121 against clamp 123 which bears against a second brake shoe assembly 125 thereby forcing plate 54 of the co-axial shaft assembly against the other plate 58 of the cylinder assembly and locking the plate and assembly together. Thus, the co-axial shaft assembly and cylinder assembly will rotate as a unit during machine operation. The spherical interface between clamp and brake shoe assembly, and the spherical head of pin 127 also ensure uniform intimate contact on this side of the structure. Screw 129 captures clamp 123 and brake shoe assembly 125 to prevent them from rotating relative to each other.

Reversing rotation of knob 111 while tool 107 is engaged with nut 105 loosens the clamping action and allows the cylinder assembly to be rotated independently of gear 68 and the co-axial shaft assembly. As noted, gear 74 is fastened to the cylinder assembly by means of screws 77 and these rotate as a unit.

As noted, the tubular shaft 86 is mounted for shifting movement relative to stationary shaft 66. This arrangement is provided for purposes of providing different positions for the cams on the shaft 86 depending upon the mode of operation involved. Thus, certain cams may be rendered inoperative in a simplex or duplexing mode.

The shifting mechanisms are best illustrated in FIGS. 11 and 21. The mechanisms include a fork 112 having engaging rollers 114 at each end. The rollers 114 are seated within groove 116 defined by fitting 118. The cross-bar 120 carries a fitting 122 which is tied to shaft 124. This shaft extends through opening 126 in plate 82, and the shaft is normally urged to the right by means of spring 128. The opposite end of the shaft is received in opening 129 defined by the opposite plate 82, and a ball 127 is supported at this end of the shaft.

The ball 127 is received within an opening 125 defined by support 58. This places the ball in engagement with the surface of plate 56.

The surface of plate 56 engaged by ball 127 includes a depression 131. This depression is encountered by the ball when the gripper 20 is in the simplexing mode, that is, the relationship shown in FIG. 11. This results in shifting of tubular shaft 86 to the right-hand position whereby cams carried by the shaft are positioned to actuate cam followers necessary for conducting the simplexing operation.

When the gripper 20 is moved out of the simplexing position, the ball 127 is moved out of depression 131 whereby the shaft 124 and associated fork 112 drive the tubular shaft 86 to the left. This shifts the cam positions to a duplexing mode, and it will be appreciated that these positions are maintained irrespective of the relative positions of the grippers 20 and 22.

FIGS. 5 through 12 illustrate the manner in which the cam elements are utilized for controlling the various gripper operations. In FIGS. 5 and 12, the gripper 20 is illustrated as including movable jaws 130 and 132. The jaw 130 is attached to the inner shaft 30, and the jaw 132 to outer shaft 32. It will be appreciated that the hinged illustration of the jaw structure comprises only an example of various gripper designs, and that other designs known to those in this art are contemplated.

Link 34 and an example of a suitable assembly 38 for controlling movement of the link is illustrated in FIG. 5. In this instance, cam follower 40 is secured to first lever 134 which is pivotable about pin 136. This lever and lever 138 comprise a split-lever assembly connected at pivot 144. Spring 142 connected to fixed arm 140 urges the assembly clockwise whereby the spring action drives the end 146 of lever 138 against lever 134 thereby forcing cam follower 40 against the surface of cam 42. It will be appreciated that as the follower 40 follows the surface of cam 42, the link 34 will oscillate thereby opening and closing the gripper 20.

The arm 140 which supports one end of spring 142 is connected to tie bar 148 and also provides support for pivot pin 136. When the gripper positions are adjusted, as by means of a hand wheel conventionally used for rotating the cylinders, the cam follower assembly will automatically move with gripper 22. This is also true of the other cam follower assemblies which are similary connected to cylinder 16. As shown in FIG. 5, the tie bar 148 may be moved between the opposite ends of the slot 50 with the degree of rotation available accommodating all practical modes of operation.

FIG. 5 also illustrates the respective extreme positions for gripper 22 including the simplex position (solid line) and the maximum duplex position (dotted line). FIGS. 6 through 10 illustrate the means employed for operating the dual gripper 22. The cam assemblies shown in FIG. 21 are utilized for controlling the functions illustrated.

The dual gripper 22 consists of a shaft 150 which supports separate sets of jaws. These jaws are preferably spring loaded into engagement as will be more specifically explained, and the entry ends thereof are opened by pushing the ends apart.

FIGS. 14 through 20 illustrate an example of a suitable design for a dual gripper 22. This structure includes opposed gripper jaws 240 which include an engaging end 242. The ends 242 are adapted to press against the ends 244 of opposite gripper jaws 246. The jaws 246 are mounted on collars 248 which are positioned in spaced relationship on shaft 250. Fasteners 247 secure the jaws in place with one jaw extending in each direction. The jaws 240 include knuckle sections 252 which extend around shaft 250 whereby the jaws are held on the shaft. The jaws 240 and 246 are all free for rotation about the shaft.

Figure 20:
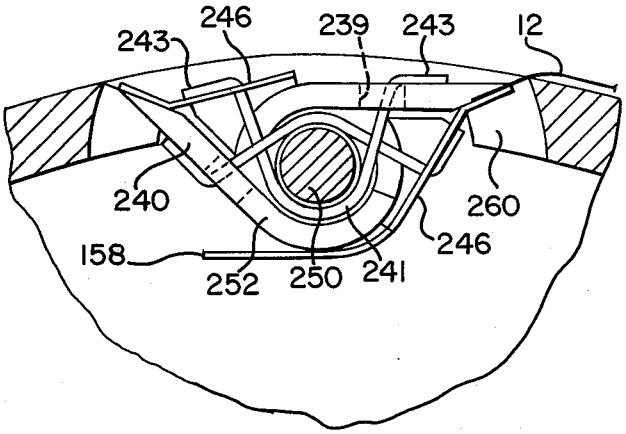

The jaws 240 define cut-out portions 256 and 257 at spaced intervals and similar cut-outs 258 and 259 are defined by the jaws 246. The cut-out portions 256 and 258 permit access of gripper means 24 for transfer of sheets after imaging, this transfer taking place, as noted, in conventional fashion. The cut-out portions 257 and 259 permit gripper jaw movement free of interference from cylinder anvil portions 260. These anvil portions are engaged by sheets held by the gripper jaws as shown in FIG. 20.

Springs 241 serve to normally hold the respective jaws together. These springs extend around the shaft 250 and ends 243 extend through openings 239 in the respective jaws and bear against jaw surfaces. Additional springs 245 (FIG. 17) each have one end 247 attached to shaft 250. The springs extend through openings 251 with the other ends 249 each engaging a jaw 240. These springs 245 urge the jaws into the straight line attitude of FIG. 17.

The jaws 240 and 246 also define openings 152 and 154, which are provided for receipt of pins 160 and 192, respectively. Jaws 240 each define projections 156 which are engageable by pin 194 during a duplexing operation while one jaw 246 defines projection 158 which is engageable by pin 162 during a simplexing operation. These functions will now be described in greater detail.

In the arrangement shown in FIG. 6, upper jaw 240 is engaged by threaded pin 160, this pin extending through opening 152 in lower jaw 246. The pin 160 is mounted on lever 164 which pivots around pin 166 attached to an end plate 82. The threaded pin 162 is supported on lever 168 which is also pivotally mounted on pin 166. This pin is engaged with projection 158.

Each of the levers is connected to a spring with one spring 170 illustrated. This spring is attached to pin 172 mounted on end plate 82, and each of the levers is thereby urged clockwise relative to pin 166. This urges cam followers associated with the levers into engagement with cam 88. The cam follower 176 associated with lever 168 is illustrated while the cam follower associated with lever 164 is positioned immediately behind the follower 176.

FIG. 6 illustrates the operation during a simplexing mode wherein the gripper 22 is employed for receiving the leading end of a new sheet. As the plate 82 rotates with the impression cylinder, the cams and cam followers urge the levers 164 and 168 into the position shown in FIG. 6 whereby the pin 160 forces jaw 240 outwardly relative to jaw 246. The pin 162 prevents pivoting of jaw 246 due to engagement with extension 158 of the jaw. The jaws 240 and 246 are closed by spring action due to a decline in the cam surfaces whereby the leading edge of the sheet 12 can be firmly gripped for passage of the sheet between the blanket and impression cylinders. A single image is applied, and the sheet is then discharged, for example, by providing an appropriate rise on the controlling cam in a position beyond the imaging position whereby the jaws are reopened. The cam surface controlling pin 162 may be designed to permit jaw 246 to move outwardly beyond the periphery of cylinder 16 at this time thereby forcing the sheet edge outwardly and simplifying the discharge.

FIG. 7 illustrates additional jaw control means. In this instance, the opposite set of jaws 240 and 246 are controlled by the cooperative action of pins 192 and 194. The pins are mounted, respectively, on levers 196 and 198, and each lever is supported by a pin 200 mounted on end plates 82. Each lever supports a cam roller such as roller 202 with each roller engaging a cam such as cam 90. In the manner previously described, the pin 192 is driven against jaw 246 while pin 194 engages extension 156 of jaw 240 to prevent pivoting of this jaw. Spring 207 holds the followers against the cams.

FIGS. 8 and 21 illustrate a feature of the invention wherein a stop member 178 comprising spaced-apart fingers 179 is associated with gripper 22. This stop member is mounted on lever 180 which may also be supported by pin 166. The lever supports cam follower 182 which engages cam 92. Spring 186 holds the follower against the cam surface.

By providing a rise in the controlling cam as the gripper 22 approaches the copy sheet input station, the stop member 178 is received by the jaws whereby the leading edge of each copy sheet can be properly aligned by the spaced-apart fingers of the stop member, and the stop member also controls the precise edge position of sheets entering the equipment. This controls the relationship of the image to the copy sheet once the image is applied during the simplexing mode of operation.

As noted, in the operation of the apparatus in the duplexing mode, the trailing end of the sheet is gripped as shown in FIG. 7, and the gripper 22 is thereafter inverted with the gripper then proceeding around for application of a second image to the sheet. This set of jaws is then opened, for example, by utilization of the pins 160 and 162 of FIG. 6 since these jaws will now be in the same attitude as the jaws of FIG. 6.

FIGS. 9 to 11 illustrate mechanisms employed for reversing the dual gripper 22 during a duplexing mode. The means shown are supported within the impression cylinder including a pin 212 mounted on an end plate 82. Spring 214 serves to connect this pin with lever 216, and this lever supports cam follower 218. The cam follower, in turn, engages 89 whereby the lever is adapted to pivot about pin 224 in response to the cam action.

The lever 216 defines teeth 226 which engage pinion 228 connected to shaft 250 by means of one way clutch 230. The rotation of the impression cylinder causes the lever 216 to pivot to the dotted line position shown as the dual gripper approaches a reversing position. This causes approximately 180° rotation of the gripper 22. As the cam surfaces declines, the spring 214 returns the lever to its original position without rotating the gripper due to the one way clutch and the lever is then in position to again rotate the gripper 22 through 180° during the next turn of the impression cylinder.

FIG. 10 illustrates the manner in which the structure shown in FIGS. 6 and 7 is moved out of position to permit rotation of the gripper 22. Thus, it will be noted that springs 170 and 207 pull the respective followers 176 and 202 inwardly against low points of the respective cams whereby all of the gripper actuating pins are moved inwardly a distance sufficient to permit rotation of the gripper 22. Once the reversing action is completed, the jaws are moved to the position of FIG. 20 by the pins.

The invention also contemplates the use of a sheet deflector consisting of roller 208 supported on lever 210. As previously discussed, the gripper 22 is adapted to engage the trailing end of a sheet during the duplexing mode. Once the equipment has been properly adjusted, the jaws 240 and 246 will be in a position to receive the trailing end of a sheet 12 just prior to passage of the sheet completely between the blanket and impression cylinders. The deflector 208 serves to engage each copy sheet entering the machine and to press this sheet against the impression cylinder. This has been found to be an effective means for insuring engagement of the gripper with the trailing end of a newly introduced sheet. Thus, the deflector forces the end of the sheet against the impression cylinder surface which insures that the trailing end of the sheet will be pressed downwardly into the jaws 240 and 246.

The structures described will operate in the manner illustrated in FIGS. 3 and 4. Specifically, when producing copies imaged on one side only, the structure will assume the position shown in FIGS. 4*a*–4*b*, that is, the grippers 20 and 22 will be positioned adjacent each other and the gripper 22 will be utilized for receiving each copy sheet. The cam shaft 86 will be positioned as shown in FIG. 21 to provide for operation of the pushers 160 and 162. This shifting may also be utilized for avoiding inverting of the gripper 22 by the mechanisms of FIGS. 9 and 10. In addition, the operation of the mechanisms for opening and closing the unused set of jaws is avoided. The operation will thus consist of the receipt of a sheet by one set of jaws 240 and 246 once during each revolution and release of the sheets after imaging. Any appropriate collection means, for example, grippers of the type shown at 24 in FIG. 1 may be utilized for moving these sheets to a receiver tray.

When duplexing is to be accomplished, the gripper 22 will be shifted to a position such as shown in FIGS. 3*c*–3*d* or to an intermediate position depending upon the size of the copy sheets involved. The cam shaft 86 will also be shifted automatically whereby the appropriate cams for the duplexing operation are brought into position. These include the cams for operating gripper 20 and for operating the pins 192 and 194 whereby a tail gripping function can be achieved.

The gripper 20 will receive the leading end of each sheet, appropriate high points on cam 42 and 43 being positioned for opening jaws 130 and 132 as each sheet is fed to the impression cylinder. Additional high points on the cams will again open the jaws for release of each sheet in the reversing area and stripper fingers may be provided in a conventional fashion for directing the sheets in this area.

In the meantime, the pins 192 and 194 will open one pair of gripper jaws for engaging the trailing end of each sheet as shown in FIG. 6. These pins will operate on a different pair of the jaws of gripper 22 during each revolution. As indicated, the rearward pair of jaws will also be opened to release each sheet for movement to a collection area after the second image has been applied.

It will be understood that various changes and modifications may be made in the above described system which provide the characteristics of this invention without departing from the spirit thereof particularly as set forth in the following claims.

That which is claimed is:

1. In a duplicating system including transfer means defining a surface carrying images transferrable to copy sheets, a carrier mounted adjacent said transfer means, first and second grippers associated with the carrier, and means for feeding copy sheets to said first gripper whereby the first gripper holds the sheets on the carrier during transfer of images from said surface to said sheets, the improvement comprising mounting means for one of said grippers, means for moving said mounting means relative to the other gripper to vary the distance between the grippers, and means for locking said mounting means and associated gripper in place relative to the carrier to maintain the relative positions of said grippers during a duplicating operation, said mounting means including portions extending outwardly beyond the periphery of the carrier, the gripper associated with the mounting means being attached to said outwardly extending portions and extending along the length of the carrier between said portions, and wherein the gripper associated with the mounting means includes opposed sets of gripping jaws, coaxial shaft means comprising one shaft portion supporting one set of said jaws, and another shaft portion supporting the other set of jaws, and means for driving one portion of the coaxial shaft means relative to the other portion for opening and closing said jaws.

2. A system in accordance with claim 1 including a cam follower carried by said mounting means, said cam follower being attached to one shaft portion whereby driving of the cam follower results in movement of the one shaft portion, said cam follower being movable with said mounting means when varying the distance between grippers, and cam means engageable with said cam follower for driving the cam follower, said carrier comprising an impression cylinder, and a supporting shaft for the cylinder, said cam means being positioned on said shaft, and said cylinder being rotatable around the shaft.

3. A system in accordance with claim 2 including additional cam means supported on said shaft, additional cam followers supported by said impression cylinder and engageable with said additional cam means, relatively movable gripper jaws associated with the other gripper, and means operatively connecting said additional cam followers with said jaws of the other gripper for opening and closing said jaws of the other gripper.

4. A system in accordance with claim 3 including jaw engaging pins connected to said additional cam followers, said other gripper including separate pairs of jaws, said pins selectively engaging said pairs for controlling the opening and closing of said pairs.

5. In a duplicating system including a surface for carrying images transferrable to copy sheets, a carrier, drive means for moving the surface and carrier in unison, means for feeding copy sheets between the surface and carrier, and gripper means associated with the carrier for gripping edges of sheets fed to the carrier and for holding the sheets on the carrier, said gripper means including a first gripper for gripping second gripper after formation of the first image whereby the second gripper holds the sheet during formation of a second image thereon, the improvement including mounting means for said first gripper, means for moving said mounting means relative to said second gripper to vary the distance between the grippers depending on the size of the copy sheets whereby the second gripper will be in position to engage the trailing edges of the sheets, and means for locking said mounting means in place on said carrier during the operation of the system, said second gripper including relatively movable gripper jaws, cam means, cam followers engageable with said cam means, and jaw engaging means operatively connecting said cam followers with said jaws for opening and closing said jaws, said jaw engaging means operating to separate said jaws while moving the lower one of said jaws outwardly relative to the periphery of said carrier, said lower one of said jaws thereby pushing the edge of the sheet held by the jaws outwardly to facilitate removal of the sheet from the carrier.

6. A system in accordance with claim 5 including a cam follower carried by said mounting means, said cam follower being attached to one shaft portion whereby driving of the cam follower results in movement of the one shaft portion, said cam follower being movable with said mounting means when varying the distance between grippers, and cam means engageable with said cam follower for driving the cam follower, said carrier comprising an impression cylinder, and a supporting shaft for the cylinder, said cam means being positioned on said shaft, and said cylinder being rotatable around the shaft.

7. A system in accordance with claim 6 including additional cam means supported on said shaft, additional cam followers supported by said impression cylinder and engageable with said additional cam means, relatively movable gripper jaws associated wih the other gripper, and means operatively connecting said additional cam followers with said jaws of the other gripper for opening and closing said jaws of the other gripper.

8. A system in accordance with claim 7 including jaw engaging pins connected to said additional cam followers, said other gripper including separate pairs of jaws, said pins selectively engaging said pairs for controlling the opening and closing of said pairs.

9. A system in accordance with claim 8 wherein the shaft supporting said cam means comprises a cylindrical shaft, a separate shaft within said cylindrical shaft, means trying the cylindrical shaft to the separate shaft, and shifting means for moving said cylindrical shaft axially relative to the separate shaft to thereby change the cam positions relative to the cam followers.

10. A system in accordance with claim 9 wherein only one of said grippers is utilized for engaging copy sheets during a simplexing operation, said shifting means being employed for changing cam positions depending upon the mode of operation of the system.

11. In a duplicating system including a surface for carrying images transferrable to copy sheets, a carrier, drive means for moving the surface and carrier in unison, means for feeding copy sheets between the surface and carrier, and gripper means associated with the carrier for gripping edges of sheets fed to the carrier and for holding the sheets on the carrier, said gripper means including a first gripper for gripping the leading edge of each sheet to hold the sheet during formation of a first image thereon, a second gripper for gripping the trailing edge of each sheet, and means for inverting said second gripper after formation of the first image whereby the second gripper holds the sheet during formation of a second image thereon, the improvement including mounting means for said first gripper, means for moving said mounting means relative to said second gripper to vary the distance between the grippers depending on the size of the copy sheets whereby the second gripper will be in position to engage the trailing edges of the sheets, and means for locking said mounting means in place on said carrier during the operation of the system, said second gripper including relatively movable gripper jaws, cam means, cam followers engageable with said cam means, and jaw engaging means operatively connecting said cam followers with said jaws for opening and closing said jaws, said jaw engaging means operating to separate said jaws while moving the lower one of said jaws outwardly relative to the periphery of said carrier, said lower one of said jaws thereby pushing the edge of the sheet held by the jaws outwardly to facilitate removal of the sheet from the carrier.

12. In a duplicating system including transfer means defining a surface carrying images transferrable to copy sheets, a carrier mounted adjacent said transfer means, first and second grippers associated with the carrier, and means for feeding copy sheets to said first gripper whereby the first gripper holds the sheets on the carrier during transfer of images from said surface to said sheets, the improvement comprising mounting means for one of said grippers, means for moving said mounting means relative to the other gripper to vary the distance between the grippers, and means for locking said mounting means and associated grippers in place relative to the carrier to maintain the relative positions of said grippers during a duplicating operation, said mounting means including portions extending outwardly beyond the periphery of the carrier, the gripper associated with the mounting means being attached to said outwardly extending portions and extending along the length of the carrier between said portions, the gripper associated with the mounting means including opposed gripping jaws, co-axial shaft means comprising one shaft member supporting one set of said jaws, and another shaft member supporting the other set of jaws, and means for driving one portion of the co-axial shaft means relative to the other portion for opening and closing said jaws, and including a cam follower carried by said mounting means, said cam follower being attached to one shaft member whereby driving of the cam follower results in movement of the one shaft member, said cam follower being movable with said mounting means when varying the distance between gripers, and stationary cam means engageable with said cam follower for driving the cam follower, said carrier comprising an impression cylinder, and a supporting shaft for the cylinder, said cam means being positioned on said supporting shaft and said cylinder being rotatable around the supporting shaft, additional cam means supported on said supporting shaft, additional cam followers supported by said impression cylinder and engageable with said additional cam means, relatively movable gripper jaws associated with the other gripper, and means operatively connecting said additional cam followers with said jaws of the other gripper for opening and closing said jaws of the other gripper, engaging pins connected to said additional cam followers, said other gripper including separate pairs of jaws, said pins selectively engaging said pairs for controlling the opening and closing of said pairs, and wherein the supporting shaft for said cams comprises a cylindrical shaft, a separate shaft within said cylindrical shaft, means trying the cylindrical shaft to the separate shaft, and shifting means for moving said cylindrical shaft axially relative to the separate shaft to thereby change the cam positions relative to the cam followers.

13. A system in accordance with claim 12 wherein said first and second grippers are both utilized for engaging copy sheets during a duplexing operation, and wherein only one of said grippers is utilized for engaging copy sheets during a simplexing operation, said shifting means being employed for changing cam positions depending upon the mode of operation of the system.

14. In a duplicating system including a surface for carrying images transferrable to copy sheets, a carrier, drive means for moving the surface and carrier in unison, means for feeding copy sheets between the surface and carrier, and gripper means associated with the carrier for gripping edges of sheets fed to the carrier and for holding the sheets on the carrier, said gripper means including a first gripper for gripping the leading edge of each sheet to hold the sheet during formation of a first image thereon, a second gripper for gripping the trailing edge of each sheet, and means for inverting said second gripper after formation of the first image whereby the second gripper holds the sheet during formation of a second image thereon, the improvement including mounting means for said first gripper, means for moving said mounting means relative to said second gripper to vary the distance between the grippers depending on the size of the copy sheets whereby the second gripper will be in position to engage the trailing edges of the sheets, and means for locking said mounting means in place on said carrier during the operation of the system, and wherein said carrier comprises a first cylinder, said surface for carrying images being defined by an adjacent second cylinder, intermeshing gears associated with said cylinders for moving the cylinders in unison, and a recess defined by said second cylinder for receiving said first gripper as the first gripper moves adjacent the second cylinder once during each rotation of the cylinders, means attaching the gear associated with said first cylinder to said mounting means, and wherein said locking means comprise releasible locking means attaching said associated gear to the first cylinder whereby upon release of said locking means said first cylinder can be moved relative to said mounting means without disturbing the relationship of said mounting means and said recess.

15. A system in accordance with claim 14 wherein said mounting means include portions extending outwardly beyond the periphery of the carrier, said first gripper being attached to said outwardly extending portions and extending along the length of the carrier between said portions.

16. A system in accordance with claim 15 wherein said first gripper includes opposed sets of gripping jaws, co-axial shaft means comprising one shaft portion supporting one set of said jaws, and another shaft portion supporting the other set of said jaws, and means for driving one portion of the co-axial shaft means relative to the other portion for opening and closing said jaws.

17. A system in accordance with claim 16 including a cam follower carried by said mounting means, said cam follower being attached to one shaft portion whereby driving of the cam follower results in movement of the one shaft portion, said cam follower being movable with said mounting means when varying the distance between grippers, and cam means engageable with said cam follower for driving the cam follower, said first cylinder comprising an impression cylinder, and a supporting shaft for said first cylinder, said cam means being positioned on said shaft, and said first cylinder being rotatable around the shaft.

18. A system in accordance with claim 17 including additional cam means supported on said shaft, additional cam followers supported by said impression cylinder and engageable with said additional cam means, relatively movable gripper jaws associated with said second gripper, and means operatively connecting said additional cam followers with said jaws of the second gripper for opening and closing said jaws of the second gripper.

19. A system in accordance with claim 18 including jaw engaging pins connected to said additional cam followers, said second gripper including separate pairs of jaws, said pins selectively engaging said pairs for controlling the opening and closing of said pairs.

20. A system in accordance with claim 19 wherein the shaft supporting said cam comprises a cylindrical shaft, a separate shaft within said cylindrical shaft, means tying the cylindrical shaft to the separate shaft, and shifting means for moving said cylindrical shaft axially relative to the separate shaft to thereby change the cam positions relative to the cam followers.

21. A system in accordance with claim 20 wherein only said second gripper is utilized for engaging copy sheets during a simplexing operation, said shifting means being employed for changing cam positions depending upon the mode of operation of the system.

22. A system in accordance with claim 19 including gear means associated with said second gripper, a gear segment engaging said gear means, and cam means operating to drive said gear segment and gear means for rotating said second gripper through 180° once during each revolution of the impression cylinder.

23. A system in accordance with claim 22 including means for retracting said engaging pins during said rotation of said second gripper.

24. A system in accordance with claim 14 including means for engaging the trailing edge of each sheet while said second gripper is in position to engage said trailing edge for thereby stuffing said trailing edge into the second gripper.

25. In a duplicating system including transfer means defining a surface carrying images transferrable to copy sheets, a carrier mounted adjacent said transfer means, first and second grippers associated with the carrier, and means for feeding copy sheets to said first gripper whereby the first gripper holds the sheets on the carrier during transfer of images from said surface to said sheets, the improvement comprising mounting means for one of said grippers, means for moving said mounting means relative to the other gripper to vary the distance between the grippers, and means for locking said mounting means and associated gripper in place relative to the carrier to maintain the relative positions of said grippers during a duplicating operation, said mounting means including portions extending outwardly beyond the periphery of the carrier, the gripper associated with the mounting means being attached to said outwardly extending portions and extending along the length of the carrier between said portions, said carrier comprising a first cylinder and wherein said surface for carrying images is defined by an adjacent second cylinder, intermeshing gears associated with said cylinders for moving the cylinders in unison, and a recess defined by said second cylinder for receiving said first gripper as said first gripper moves adjacent the second cylinder once during each rotation of the cylinders, means attaching the gear associated with said first cylinder to said mounting means, and wherein said locking means comprise releasible locking means attaching said associated gear to the first cylinder whereby upon release of said locking means, said first cylinder can be moved relative to said mounting means without disturbing the relationship of said mounting means and said recess.

26. In a duplicating system including a surface for carrying images transferrable to copy sheets, a carrier, drive means for moving the surface and carrier in unison, means for feeding copy sheets between the surface and carrier, and gripper means associated with the carrier for gripping edges of sheets fed to the carrier and for holding the sheets on the carrier, said gripper means including a first gripper for gripping the leading edge of a sheet to hold the sheet during formation of a first image thereon, a second gripper for gripping the trailing edge of the sheet, and means for inverting said second gripper after formation of the first image whereby the second gripper holds the sheet during formation of a second image thereon, the improvement including mounting means for one of said grippers, means for moving said mounting means relative to the other gripper to vary the distance between the grippers, and means for locking said mounting means in place on said carrier whereby sheets of varying sizes can be employed, said carrier comprising a first cylinder and wherein said surface for carrying images is defined by an adjacent second cylinder, intermeshing gears associated with said cylinders for moving the cylinders in unison, and a recess defined by said second cylinder for receiving said first gripper as said first gripper moves adjacent the second cylinder once during each rotation of the cylinders, means attaching the gear associated with said first cylinder to said mounting means, and wherein said locking means comprise releasible locking means attaching said associated gear to the first cylinder whereby upon release of said locking means, said first cylinder can be moved relative to said mounting means without disturbing the relationship of said mounting means and said recess.

27. In a duplicating system including a surface for carrying images transferrable to copy sheets, a carrier, drive means for moving the surface and carrier in unison, means for feeding copy sheets between the surface and carrier, and gripper means associated with the carrier for gripping edges of sheets fed to the carrier and for holding the sheets on the carrier, said gripper means including a first gripper for gripping the leading edge of each sheet to hold the sheet during formation of a first image thereon, a second gripper for gripping the trailing edge of each sheet, and means for inverting said second gripper after formation of the first image whereby the second gripper holds the sheet during formation of a second image thereon, the improvement including mounting means for said first gripper, means for moving said mounting means relative to said second gripper to vary the distance between the grippers depending on the size of the copy sheets whereby the second gripper will be in position to engage the trailing edges of the sheets, and means for locking said mounting means in place on said carrier during the operation of the system, said carrier comprising a first cylinder and wherein said surface for carrying images is defined by an adjacent second cylinder, intermeshing gears associated with said cylinders for moving the cylinders in unison, and a recess defined by said second cylinder for receiving said first gripper as said first gripper moves adjacent the second cylinder once during each rotation of the cylinders, means attaching the gear associated with the first cylinder to said mounting means, and wherein said locking means comprise releasible locking means attaching said associated gear to the first cylinder whereby upon release of said locking means, said first cylinder can be moved relative to said mounting means without disturbing the relationship of said mounting means and said recess.

* * * * *